US005416931A

United States Patent [19]

Wolfenden et al.

[11] Patent Number: 5,416,931

[45] Date of Patent: May 23, 1995

[54] BOOTH

[75] Inventors: Richard R. Wolfenden, Shelf Halifax; Graham Priestley, Hinderwell Saltburn-by-Sea, both of Great Britain

[73] Assignee: Aromatherapy Steam Tube Company Limited, Shelf, Great Britain

[21] Appl. No.: 250,932

[22] Filed: May 31, 1994

Related U.S. Application Data

[63] Continuation of Ser. No. 937,884, Oct. 19, 1992, abandoned.

[30] Foreign Application Priority Data

Feb. 23, 1990 [GB] United Kingdom ..... 9004182

[51] Int. Cl.[6] ..... A61H 33/00

[52] U.S. Cl. ..... 4/524; 4/524; 4/526; 4/528; 4/531; 607/81; 607/83

[58] Field of Search ..... 4/224, 525, 526, 527, 4/528, 529, 530, 531, 332, 533, 534, 535, 536, 599, 602, 603, 580, 581; 128/365, 367, 368, 369, 371, 373; 607/81, 83

[56] References Cited

U.S. PATENT DOCUMENTS

| | | | |
|---|---|---|---|
| 829,281 | 8/1906 | Monro | 4/527 |
| 2,503,174 | 4/1950 | Salvador | 4/581 |
| 2,539,710 | 1/1951 | Sziklay | 4/527 |
| 3,629,875 | 12/1971 | Dow | 4/599 |
| 3,929,584 | 12/1975 | Mansfield | 435/3 |
| 4,336,329 | 6/1982 | Hesse et al. | 435/3 |
| 4,356,967 | 11/1982 | Lunick | 237/14 |
| 4,443,791 | 4/1984 | Risgin et al. | 340/634 |
| 4,701,415 | 10/1987 | Dutton et al. | 435/289 |
| 4,730,479 | 3/1988 | Pyke et al. | 73/23 |
| 4,833,739 | 5/1989 | Sakakibara et al. | 4/524 |
| 4,896,143 | 1/1990 | Dolnick et al. | 340/634 |
| 4,979,242 | 12/1990 | Maggio | 4/599 |

FOREIGN PATENT DOCUMENTS

| | | | |
|---|---|---|---|
| 636264 | 5/1983 | Switzerland | 4/525 |

*Primary Examiner*—Henry J. Recla
*Assistant Examiner*—Charles R. Eloshway
*Attorney, Agent, or Firm*—Reising, Ethington, Barnard, Perry & Milton

[57] ABSTRACT

A booth, of general circular cross-section, includes a roof part 2, a base part and an intermediate part 6. The base is adapted to stand on the floor. Within the booth is a foldable chair 8. A person may gain access to the booth via a door 10 having a hinged edge 12 and a slide fastener 14. A steam kettle is provided below a false floor of the base part 4. In use, steam and aromatic vapor for essential oils is produced which fills the booth within which a person is seated.

10 Claims, 4 Drawing Sheets

FIG-5
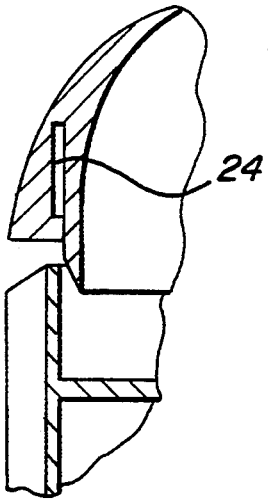
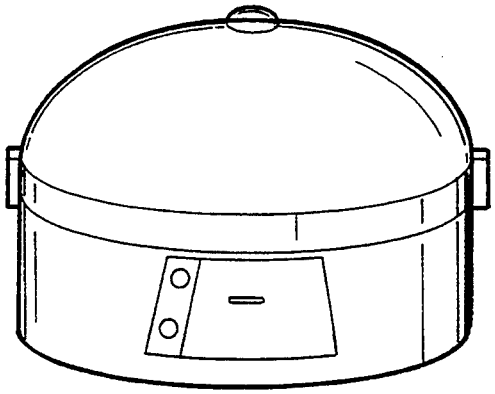
FIG-6A
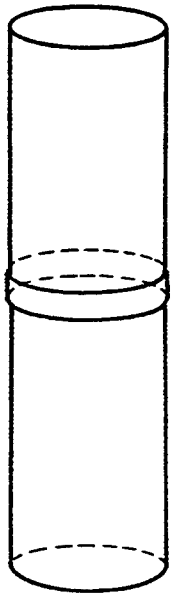
FIG-6B
FIG-6C
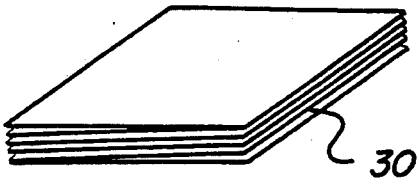
FIG-6D
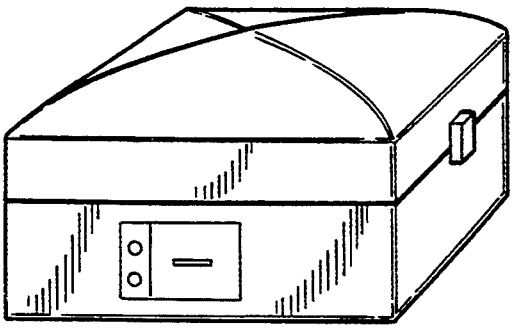
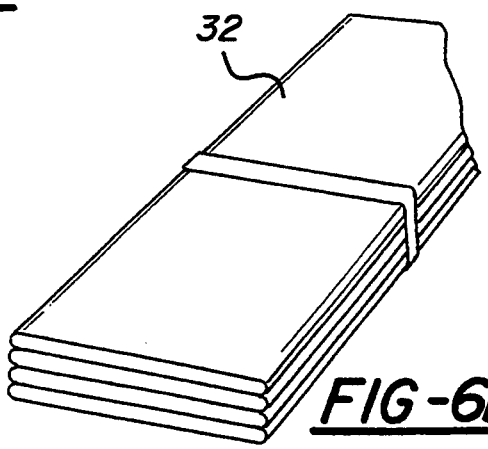
FIG-6E FIG-7A
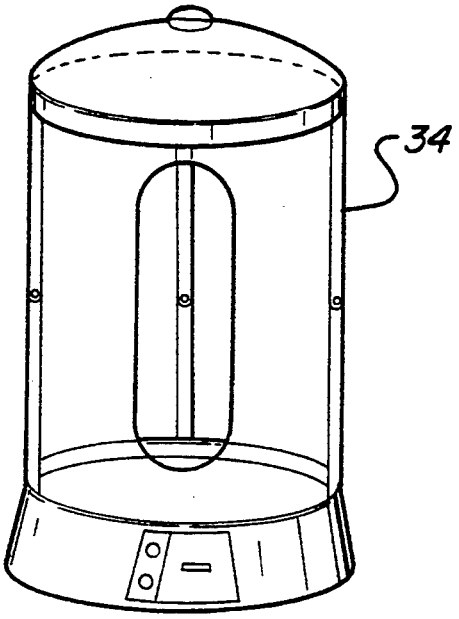
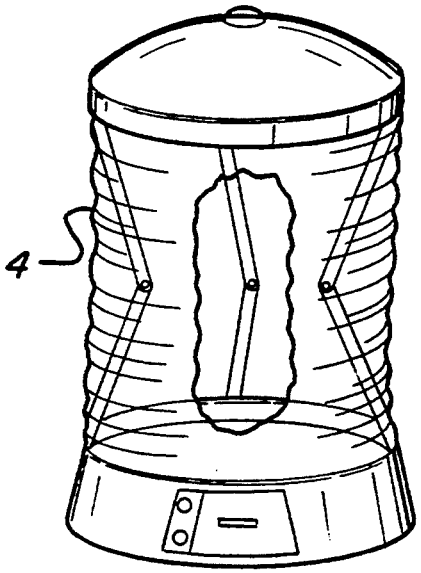
FIG-7B
FIG-7C
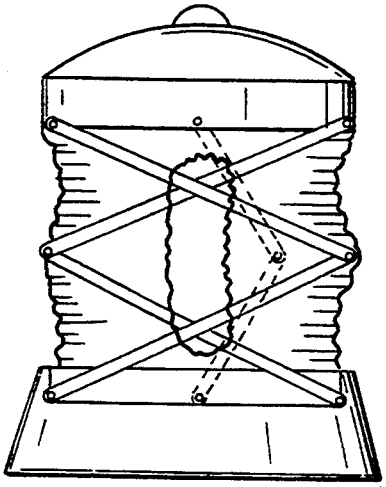
FIG-7D
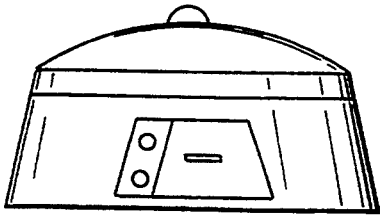

BOOTH

This application is a continuation of application Ser. No. 07/937,884, filed Oct. 19, 1992, abandoned.

FIELD OF THE INVENTION

This invention relates to a portable booth apparatus, and, in preferred embodiments, to such apparatus for providing a dry heat, steam and/or vapour environment. The invention also relates to non-portable apparatus for providing a steam or vapour environment. The invention further relates to the use of apparatus for providing a dry heat, steam or vapour environment.

BACKGROUND OF THE INVENTION

The use of dry heat, steam or vapour baths, for example Sauna or Turkish baths, has long been recognised as relaxing and beneficial. However, home units are complex and expensive, and bulky, permanent structures. Many people do not have the space to accommodate such a structure, or, even if they have the space, and can afford one, would not think the expense of installing such a unit as worthwhile, although recognising their beneficial and relaxing properties.

SUMMARY OF THE INVENTION

In accordance with a first aspect of the present invention there is provided apparatus for providing a dry heat, steam and/or vapour environment for one or more persons, the apparatus comprising an enclosure defined by an enclosure wall, the enclosure wall having an opening sufficient in size for a person to enter or leave the enclosure through it, and a closure part to close the opening, wherein the enclosure is such as to be able to be collapsed and/or taken apart in order to adopt a more readily portable configuration, and subsequently re-configured, the enclosure wall being of a material to substantially retain heat, steam and/or vapour within it, the apparatus further comprising means for raising dry heat, steam and/or vapour, characterised in that the apparatus includes a rigid base part which has a false floor for supporting a person or persons.

The means for raising dry heat, steam and/or vapour may suitably comprise an electrical heater, preferably powered by mains electricity. The apparatus may solely be arranged to produce dry heat, or solely arranged to produce steam or vapour. The apparatus is suitably adapted to raise dry heat on the one hand, and steam or vapour on the other hand, as selected. In use for raising steam or vapour, therapeutic or aromatic oils, chemicals, herbal extracts etc. may be added to water to be heated to give aromatic vapour.

The apparatus may comprise thermostatic control means comprising a thermostat to sense the temperature within the enclosure and means to interrupt the supply of current to the heater when a pre-determined temperature (which is suitably under the control of the occupant) is reached.

A user-operable timer is suitably provided by which a user may set the time for which he/she intends to be within the dry heat, steam or vapour environment.

The enclosure is suitably collapsible. Thus, the enclosure wall is suitably of a flexible sheet material. The flexible sheet material may be arranged to define an elongate arrangement in use, wherein the height of the arrangement is greater than the width. It is preferably sufficiently rigid in itself to support a roof part of the apparatus. Preferably, the flexible sheet material defines a cylinder in use which is sufficiently rigid in itself to support a roof part of the apparatus. The enclosure wall may alternatively or additionally be supported by, for example, pin-jointed struts. It may be foldable in the manner of a concertina. It may be foldable along predefined fold lines, in the manner of a cardboard box. It may be such as to be rolled up for storage.

preferably, the enclosure is substantially of a plastics material. Suitably, at least a part of the enclosure wall is transparent. In certain embodiments the enclosure wall could be flexible, in the sense of being unable to support itself, so requiring means such as struts to support it, but in other embodiments the enclosure wall could be flexible but self-supporting, or rigid.

The apparatus is suitably arranged to channel water therein into a well disposed at a lower end of the apparatus. Suitably, means, for example, a sponge is provided in the well for absorbing water. In use, the sponge may be removed from the well and the water squeezed from the sponge.

Suitably, the apparatus is sufficiently light as to be easily carried. For example, it may weigh no more than 20 or 30 pounds. Preferably, it weighs less than 20 pounds. Preferably, the apparatus includes a fluid reservoir, suitably an integral fluid reservoir, for water, arranged such that, in use, water in the reservoir may be evaporated by the means for raising dry heat, steam and/or vapour. Thus, the apparatus, suitably requires no external plumbing for the production of steam or vapour. Alternatively, it may be plumbed in.

Preferably, the means for raising dry heat, steam and/or vapour is contained within the enclosure. However, the means for raising dry heat, steam or vapour could be located within a separate unit which is connectable to the enclosure, for example by means of a flexible hose.

The apparatus may contain within it, in use, a seat or seats appropriate for the size of the enclosure. Suitably, such seat or seats is/are collapsible or foldable.

In accordance with a second aspect of the present invention there is provided apparatus for providing a portable enclosure for one or more persons, (which enclosure may be used to provide a dry heat, steam or vapour environment, or may be used for other purposes, for example as a tent, protective capsule in toxic environments, shower enclosure etc.) the apparatus comprising a generally rigid base part, a generally rigid roof part, and an enclosure wall therebetween, the enclosure wall having an opening sufficient in size for a person to enter or leave the enclosure through it, and a closure part to close the opening, wherein the enclosure is such as to be able to be collapsed and/or taken apart in order to adopt a more readily portable configuration, and subsequently re-configured, wherein the base part and the roof are securable together in the portable configuration, the enclosure wall either being located therebetween, having been collapsed, or having been removed, characterised in that the rigid base part includes a false floor for supporting a person or persons.

Suitably, in accordance with the second aspect of the invention, the roof part and base part are securable together to form a carrying case. Thus, at least one of the parts preferably comprises a carrying handle. The roof part is preferably domed or otherwise sloped towards the sides of the enclosure, to prevent dripping of condensed water onto the occupant.

Preferably, in use, the portable enclosure is generally cylindrical in shape.

The closure part is preferably securable to substantially seal the opening, for example against the loss of dry heat, steam or vapour. To this end, the closure part may be securable around the opening by means of Velcro (Trade Mark), by slide fasteners or by zips. Suitably, the closure part is a sliding door.

The enclosure wall may be such as to efficiently retain heat within the enclosure. Thus, it may be double-glazed, or of honeycomb form.

The apparatus, or parts of it, may be inflatable. For example, the enclosure wall may be inflatable; the seat may be inflatable; and so forth.

In certain embodiments, the seat may act as a support for the roof part.

Preferred apparatus of the present invention is in accordance with both the first and second aspects defined above.

The invention extends to the use of apparatus according to any of the preceding statements for exposing a person to a dry heat, steam or vapour environment. Preferably, the apparatus is for use in aromatherapy.

DESCRIPTION OF THE DRAWINGS

The invention will now be Further described, by way of example, with reference to the accompanying drawings in which:

FIG. 5 shows a view of the connection between the top and side parts of the booth of FIGS. 1 to 4;

FIGS. 6(A)–6(E) which are various embodiments in collapsed form ready for storage or carriage;

FIGS. 7(A)–7(D) shows three views of a further embodiment, of a booth similar to that of FIG. 1 to 3, but having pin-jointed side support means;

FIG. 8 shows a hanging unit; and

FIG. 9(A)–9(B) show a unit in which the side wall is arranged to collapse in the fashion of a concertina.

DESCRIPTION OF THE PREFERRED EMBODIMENTS

Figure 1:
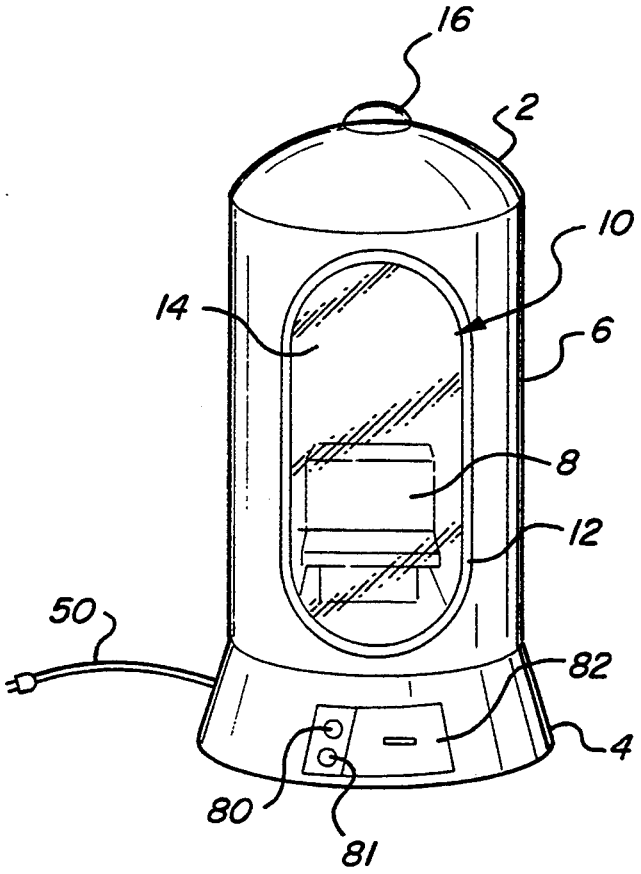
FIG. 1 shows a steam booth configured for use.

The booth shown in FIG. 1 is of size to admit a single person. It comprises a roof part 2, a base part 4, and an intermediate wall part 6. The booth is circular in cross-section. The base 4 is adapted to stand on the floor. Within the booth is a foldable chair 8. Access to the interior of the booth is via a door 10 having a hinge edge 12 and, around the rest of the opening, slide fastener 14.

Figure 4A:
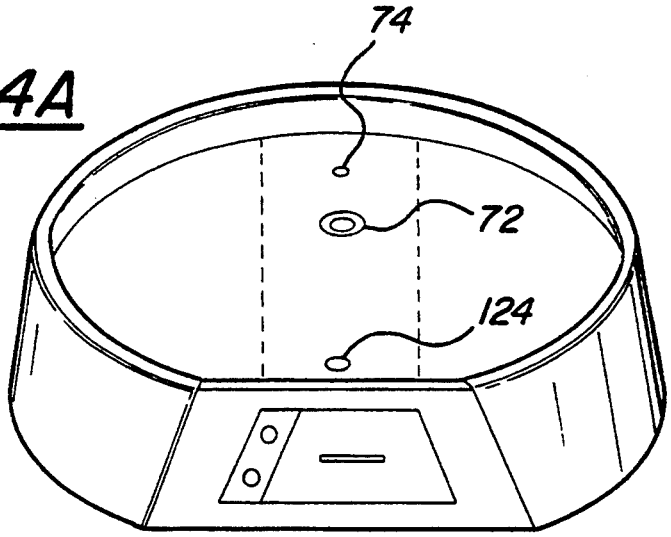
FIGS. 4(A)–4(C) shows views, perspective, plan and elevational, of the base part of FIGS. 1 to 3.
Figure 4B:
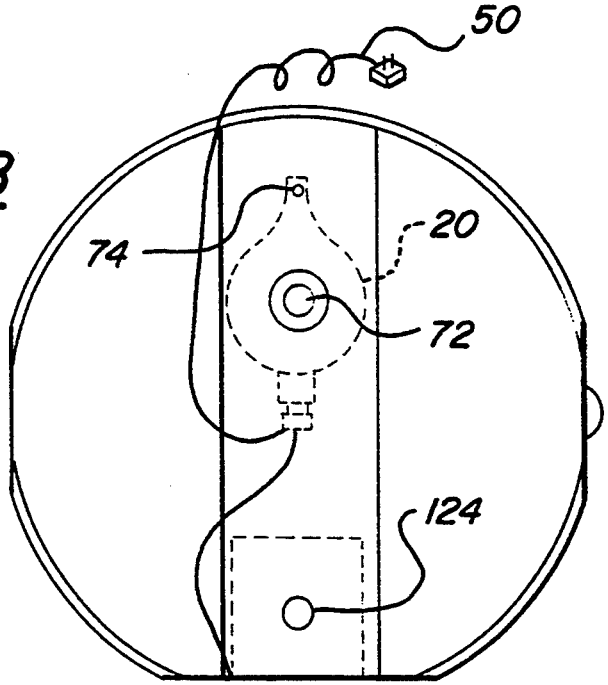
Figure 4C:
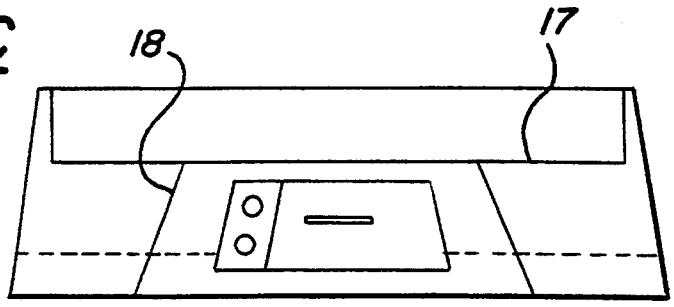

The roof part 2 is domed in shape, internally and externally, and has at its highest position a carrying handle 16. The wall part 6 and door 10 is of a self-supporting plastics sheet material, and is transparent. The seat 8 is of plastics material, and when folded, locates snugly within the interior of the booth. The base part 4, and the roof part 2, are of a plastics material. The base part 4 has a false floor 17 which is supported from beneath by ribs 18 (FIG. 4C). Beneath the false floor is a steam kettle 20. The steam kettle has a lid 72 which is used for filling purposes.

Steam issues from the kettle 20 via a steam vent 74. The vent is arranged so that steam is not directed at an occupant of the booth. In this regard, the back of chair 8 may act to deflect steam away from the occupant.

The false floor 17 slopes downwardly towards a drain plug 124.

Control means (not shown) for the steam kettle 20 is also located beneath the false floor. This control means operates in response to a signal received from a thermostat (not shown) within the enclosure proper, to interrupt the current to the electrical heater element for the kettle, when the temperature reaches a pre-determined level (which may be selected by the occupant).

A timer 80, thermostat 81 and display panel 82 are provided.

In this embodiment the kettle is powered by electricity via a flexible connector 50.

Figure 2:
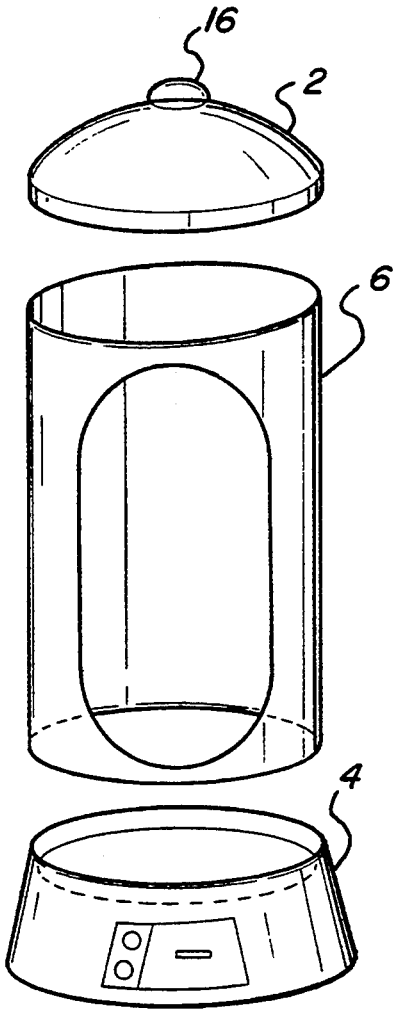
FIG. 2 shows in schematic view an exploded view of the booth of FIG. 1.
Figure 3:
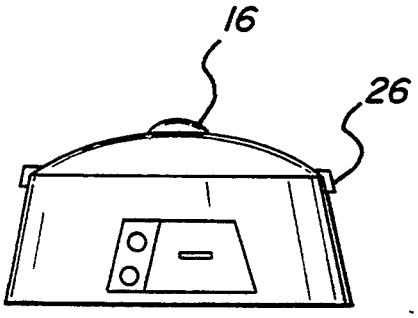
FIG. 3 shows the booth of FIG. 1 in its collapsed form ready for carriage or storage.

The apparatus may be separated into three parts, as shown in FIG. 2, by simply pulling them apart in an axial direction. The roof part is connected to the wall part by locating means shown in FIG. 5; the upper rim of the wall part fits within a circumferential groove 24 formed in the roof part. Correspondingly, the base part is connected to the lower edge of the wall part by locating means in the form of a circumferential groove into which the upper rim of the base part fits. Once the parts are separated, the folded seat may be placed on the false floor and the roof part may then be fitted against the base part, with interengagment of the rim and circumferential groove, and secured by means of toggle clips 26 (see FIG. 3). The base part/roof part assembly shown in FIG. 3 may then be carried by means of handle 16. The wall part may be rolled up for transportation.

FIGS. 6(A)–6(E) shows various other possibilities. One of the sketches shows a wall part of a flexible plastics material 30 which may be folded and placed between the roof part and the base part. Another embodiment shows a folded side wall 32 of a rigid plastics material. In the case of the flexible material, it is necessary to provide means for supporting the roof part above the base part in use. For example, struts may be employed for this purpose.

FIGS. 7(A)–7(D) show a convenient embodiment with a wall part 4 of a flexible transparent plastics material. Supporting the roof part in use above the base part are three pin-jointed struts 34 which, as shown, may be collapsed in order to bring the roof part towards the base part for storage or transportation. The diameter of the booth, and the geometry of the struts, is such that, on being collapsed, they nest between the base part and roof part.

FIG. 8 show a hanging embodiment in which the uppermost point of the roof part is provided with a hook. The purpose of the hook is not to entirely suspend the booth; the base part suitably rests in use on a floor or other flat surface. However, the hook can be connected to a tensioning means, for example a rubber bungee, whereby the booth may be drawn up to its full size. An opening 200 may be opened and closed by means of a zip.

FIGS. 9(A)–9(B) shows in schematic form an embodiment in which the wall part may be collapsed and expanded in the manner of a concertina. The wall part can be maintained in its expanded configuration by means of a hook and tensioning means, as in FIG. 8, or struts, as in earlier embodiments; and various other possibilities exist.

All of the features disclosed in this specification (including any accompanying claims, abstract and drawings), and/or all of the steps of any method or process so disclosed, may be combined in any combination, except combinations where at least some of such features and/or steps are mutually exclusive.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

We claim:

1. Apparatus for providing a heat environment for at least one person, the apparatus being configurable in an assembled configuration and a portable disassembled configuration, the apparatus comprising:

an enclosure for substantially retaining heat, steam or vapor therewithin and for receiving said at least one person and comprised of:

(i) a roof having a peripheral edge portion and adapted to extend above the head of said at least one person;

(ii) an enclosure wall having upper and lower edge portions and being made of a solid material which is sufficiently rigid that the wall is self supporting, said enclosure wall having an opening sufficient in size for said at least one person to enter and leave the enclosure, and a closure part for closing the opening, at least a portion of said wall being substantially transparent; and (iii) a base having a peripheral edge portion;

locating means adapted to locate said roof, said wall and said base relative to one another and whereby said roof is indirectly supported by said base in said assembled configuration and, said locating means including a slot extending at least partially within said peripheral edge portion of said roof for insertably receiving said upper edge portion of said wall and an upstanding rim extending around said peripheral edge portion of said base for confining said lower edge portion of said wall within said base;

raising means for raising said heat, said steam or said vapor; and securing means adapted to secure the roof and the base together to form a carrying case in said portable disassembled configuration.

2. Apparatus according to claim 1, wherein said raising means is adapted to raise an aromatic vapor.

3. Apparatus according to claim 1, wherein the enclosure wall is arranged to define a cylinder, which, in use, is sufficiently rigid in itself to support said roof.

4. Apparatus according to claim 1, wherein said raising means comprises a first reservoir for liquid supported by said base, and heating means whereby liquid in the reservoir may be evaporated to provide at least one of said steam and said vapor in said enclosure and wherein said apparatus includes a second reservoir supported by said base and in the form of a well for receiving condensate of at least one of said steam and said vapor channelled thereto by said enclosure.

5. Apparatus according to claim 4, wherein said raising means and said well are contained within the base and wherein said base includes a false floor above said raising means and said well.

6. Apparatus according to claim 1, wherein said roof has an internal surface which extends substantially continuously downwards from a center point of said roof, to prevent dripping of condensate onto said at least one person within said enclosure.

7. Apparatus according to claim 1, wherein the enclosure wall is removed from its position between said roof and said base when the apparatus is in said portable configuration.

8. Apparatus according to claim 1, wherein a major part of said enclosure wall consists of a single sheet of flexible material.

9. Apparatus according to claim 8, wherein said sheet is adapted to be rolled up into a cylindrical roll.

10. Apparatus according to claim 8, wherein said sheet is a plastic material.

* * * * *